US008356380B2

(12) United States Patent
Breitschmid

(10) Patent No.: US 8,356,380 B2
(45) Date of Patent: Jan. 22, 2013

(54) INTERDENTAL BRUSH

(75) Inventor: Ueli Breitschmid, Meggen (CH)

(73) Assignee: Curaden International AG, Kriens (CH)

( * ) Notice: Subject to any disclaimer, the term of this patent is extended or adjusted under 35 U.S.C. 154(b) by 0 days.

(21) Appl. No.: 13/238,829

(22) Filed: Sep. 21, 2011

(65) Prior Publication Data

US 2012/0073071 A1 Mar. 29, 2012

Related U.S. Application Data

(63) Continuation of application No. 10/810,901, filed on Mar. 29, 2004, now abandoned.

(30) Foreign Application Priority Data

Apr. 22, 2003 (EP) ..... 03 405 283

(51) Int. Cl.
*A46B 3/18* (2006.01)
*A46B 9/04* (2006.01)

(52) U.S. Cl. ..... 15/167.1; 15/206

(58) Field of Classification Search ..... 15/167.1, 15/206

See application file for complete search history.

(56) References Cited

U.S. PATENT DOCUMENTS

| | | | |
|---|---|---|---|
| 4,222,143 | A | 9/1980 | Tarrson et al. |
| 5,355,547 | A | 10/1994 | Fitjer |
| 5,882,584 | A | 3/1999 | Tsurukawa |
| 6,434,778 | B1 | 8/2002 | Edwards et al. |

FOREIGN PATENT DOCUMENTS

| | | | |
|---|---|---|---|
| EP | 0 001 044 | A1 | 3/1979 |
| EP | 0 203 082 | B1 | 12/1986 |
| EP | 0 800 781 | A2 | 10/1997 |
| EP | 0 892 625 | B1 | 1/1999 |
| EP | 1 087 029 | A2 | 3/2001 |
| JP | 7-227315 | A | 8/1995 |
| JP | 8-308637 | A | 11/1996 |
| JP | 9-276044 | A | 10/1997 |
| JP | 11-346831 | A | 12/1999 |

*Primary Examiner* — Randall Chin

(74) *Attorney, Agent, or Firm* — Birch, Stewart, Kolasch & Birch, LLP

(57) ABSTRACT

In an interdental brush, the filaments are retained between two wire sections (1*a*, 1*b*) which are twisted with one another. The wire sections (1*a*, 1*b*) have a diameter (D) of 0.3 mm or less and consist of a nickel-free or low-nickel steel. These brushes are distinguished by an increased level of rigidity and an improved restoring force and are stable even if the wire has a small diameter.

8 Claims, 1 Drawing Sheet

INTERDENTAL BRUSH

This application is a Continuation of U.S. patent application Ser. No. 10/810,901 filed on Mar. 29, 2004, now abandoned which claims priority under 35 U.S.C. §119(a) on Patent Application No. 03 405 283.7 filed in Europe on Apr. 22, 2003, the entire contents of which are hereby incorporated by reference.

TECHNICAL FIELD

The invention relates to an interdental brush in which filaments (or bristles) are retained between wire sections which are twisted with one another. The invention also relates to a method for producing such brushes.

PRIOR ART

Cleaning the spaces between the teeth with the aid of interdental brushes has long been an indispensable part of thorough dental care. These interdental brushes essentially comprise two thin, twisted pieces of wire between which the bristles or synthetic filaments are firmly clamped. Whereas the wire ends of the small brushes formerly had to be inserted into a handle by the user (see U.S. Pat. No. 4,222,143, Tarrson), modern interdental brushes have a plastic part which can easily be inserted in the handle (see, for example, EP 0 001 044 A1, Georg; EP 0 203 082 B1, Curaden AG). Large or small brushes are required depending on the width of the spaces between the teeth. There is thus a series of brushes with different wire and bristle diameters. Systems which allow the patient to determine the correct interdental brush easily and quickly are also already known (see, for example, EP 0 892 625 B1, Curaden A G).

It has repeatedly been found to be the case in practice that the fine interdental brushes, i.e. the brushes for the narrow spaces between the teeth, are problematic to use, i.e. easily bend during use and, in some circumstances, even break.

DESCRIPTION OF THE INVENTION

The object of the invention is to provide an interdental brush which belongs to the technical field mentioned in the introduction and is stable even if the wire has a small diameter.

According to the invention, the twisted wire sections have a diameter of 0.3 mm or less and consist of a nickel-free or low-nickel steel. "Nickel-free" or "low-nickel", in the context of the invention, refers to a steel in which the nickel content in the alloy is less than 0.05% by weight.

Interdental brushes according to the invention are distinguished by an increased level of rigidity and an improved restoring force. If the brushes, during use, are introduced, for example, obliquely into the space between the teeth and strike against something with the tips or bend, then the twisted section will not deform so easily or, if it deforms, it is not so easily subjected to permanent deformation. The properties of thin brushes in particular may thus be noticeably improved for the user. Using nickel-free wire, in addition, increases the biocompatibility of the brush, without any protective coatings being necessary.

The wire used preferably has a diameter of 0.15 mm or more. This is because practical tests have shown that the smallest interdental brushes which are customary nowadays, and have a diameter of 0.15 mm to 0.30 mm, can be used to good effect. Thick wires obviously result in more stable brushes than thin ones. In some circumstances, however, it is advantageous if the wires are not selected to be as thick as possible. Thinner wires result in more flexible brushes. A preferred wire diameter is in the range of 0.18-0.27 mm.

The wire used preferably has a tensile strength of 1000 $N/mm^2$ or more. In most cases, the tensile strength need not be greater than 1200 $N/mm^2$. Such wires do not just result in a brush with a low risk of breakage; they also allow processing in high-speed machines which provide for pronounced bending. In the case of excessive strength, processing may be rendered more difficult because the wires may break. Surprisingly, it has been found that the wires according to the invention can be processed even if they have a tensile strength of 1000 $N/mm^2$ and more. This is not the case with nickel-containing wires.

It is preferable, but not absolutely necessary, for the wires to consist of an austenite. Tests have shown that the robustness of the filament carrier, which is formed by the twisted wires, is favourably influenced as a result. In addition, the corrosion resistance ensures that brushes which have been kept in storage, or are left lying around, for a long period of time do not result in problems for the user during use (on account of corrosion having occurred in the meantime).

The operations of stretching or drawing out and twisting the wires during processing in brush production increase the tensile strength. The processed wires are a certain amount stiffer than those which have not been processed.

In mechanical and automated production of an interdental brush, in a manner known per se, filaments are introduced between two wire sections and the wire sections are twisted with the filaments. According to the invention, however, the wire used is a nickel-free one rather than a conventional nickel-containing one. The wire sections may be formed in fact by the two halves of a single piece of wire. It is also possible for them, however, to be realized by two separate wires.

Further advantageous embodiments and combinations of features of the invention can be gathered from the following detailed description and from the patent claims taken in their entirety.

BRIEF DESCRIPTION OF THE DRAWINGS

In the drawings used in order to explain the exemplary embodiment.

In the figures, it is basically the case that the same parts are provided with the same designations.

WAYS OF IMPLEMENTING THE INVENTION

Figure 1:
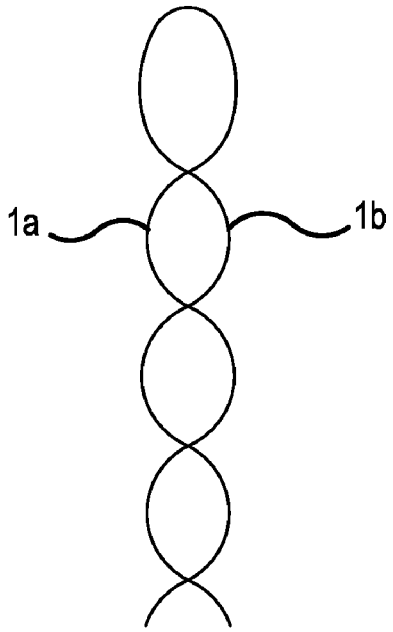
FIG. 1 shows a schematic illustration of the twisted wire.

As seen from the outside, the interdental brushes according to the invention are of the same design as those illustrated in the prior art mentioned in the introduction. FIG. 1 shows how the wire sections 1*a*, 1*b* are twisted with one another. The filaments are not depicted in FIG. 1. They are firmly clamped between the two wire sections 1*a*, 1*b*. It can be seen that the wire sections 1*a*, 1*b* are bent to a relatively pronounced extent. They form the filament carrier more or less.

Figure 2:
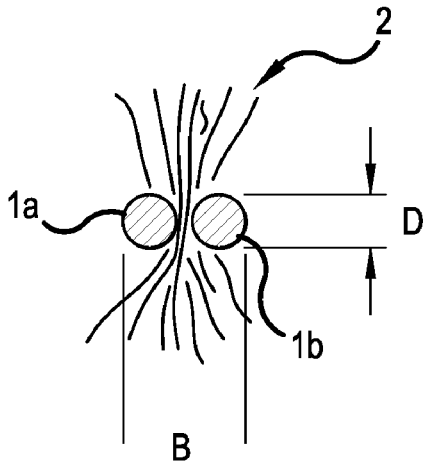
FIG. 2 shows a schematic illustration of a cross section.

FIG. 2 shows a cross section through the filament carrier. The wire sections 1*a*, 1*b* have a certain diameter D. The filaments 2 are retained between them. Their diameter D is defined such that, on the one hand, the filament carrier has a desired level of rigidity and that, on the other hand, the interdental brush is adapted to a certain degree of freedom of movement. The degree of freedom of movement may be determined, for example, by a probe, as is known from EP 0 892 625 B1, which was mentioned in the introduction. Inter alia the diameter D and the width B and the wire material used (and/or the flexibility thereof) are relevant for the freedom of movement.

Interdental brushes made of a nickel-free steel (nickel-free, in this context, means a nickel content of below 0.05% by weight) of the following composition were produced successfully (weight measurements rounded off; impurities not mentioned):

| | |
|---|---|
| 17% by weight | chromium |
| 14% by weight | manganese |
| 2% by weight | molybdenum |
| 0.5% by weight | nitrogen |
| 0.25% by weight | silicon |
| 0.11% by weight | carbon |
| 0.04% by weight | nickel |
| 0.02% by weight | phosphorus |
| 0.006% by weight | titanium |
| Remainder | iron |

The wire had a diameter of 0.23 mm and a tensile strength of at least 1100 N/mm$^2$ and not more than 1300 N/mm$^2$. Further tests were carried out with a wire having a diameter of 0.27 mm and consisting of the same alloy. The tensile strength was at least 1000 N/mm$^2$ and not more than 1200 N/mm$^2$.

The interdental brush provided with the new wire withstands three times more frequent loading under rotary bending than the traditional brush. (In the case of the so-called rotary bending, the plastic part is clamped in and a device rotates the tip of the brush in a circle.)

Of course, it is possible to vary the above alloy composition. The content of Cr and Mn may each be changed, for example, by 3% by weight. If the biocompatibility is particularly important, the content of Ni is preferably also selected to be lower.

To summarize, it may be stated that the invention provides an interdental brush with a small filament-carrier diameter and, consequently, good freedom of movement in the narrow spaces between the teeth. Even in the case of fine wire diameters, the interdental brush is highly robust.

The invention claimed is:

1. Interdental brush comprising:

two wire sections formed of austenitic steel and having a diameter of 0.3 mm or less; and filaments retained between the two wire sections which are twisted with one another, wherein:

the austenitic steel includes less than 0.05% nickel by weight, a proportion of chromium in the steel is 17% by weight, plus or minus 3% by weight, a proportion of manganese in the steel is 14% by weight, plus or minus 3% by weight, a proportion of nitrogen in the steel is 0.5% by weight, a proportion of carbon in the steel is 0.11% by weight, a proportion of molybdenum in the steel is 2% by weight, and the two wire sections have a tensile strength of 1000 N/mm$^2$ or more.

2. Interdental brush according to claim 1, wherein the two wire sections have a diameter of more than 0.15 mm.

3. Interdental brush according to claim 2, wherein the two wire sections have a tensile strength of 1200 N/mm$^2$ or less.

4. Interdental brush according to claim 1, wherein the two wire sections have a tensile strength of 1200 N/mm$^2$ or less.

5. Interdental brush according to claim 1, wherein the two wire sections are stretched or drawn out.

6. Interdental brush according to claim 1, wherein the proportion of silicon in the steel is 0.25% by weight.

7. Interdental brush according to claim 1, wherein the proportion of phosphorus in the steel is 0.02% by weight.

8. Interdental brush according to claim 1, wherein the proportion of titanium in the steel is 0.006% by weight.

* * * * *